US010709214B2

(12) United States Patent
Lin

(10) Patent No.: US 10,709,214 B2
(45) Date of Patent: Jul. 14, 2020

(54) LOCK MECHANISM FOR ACCESSORIES

(71) Applicant: REGAL JEWELRY MANUFACTURE CO., LTD., Samutsakorn (TH)

(72) Inventor: Ju-Ying Lin, Taipei (TW)

(73) Assignee: REGAL JEWELRY MANUFACTORE CO. LTD., Samutsakorn (TH)

( * ) Notice: Subject to any disclaimer, the term of this patent is extended or adjusted under 35 U.S.C. 154(b) by 234 days.

(21) Appl. No.: 15/695,890

(22) Filed: Sep. 5, 2017

(65) Prior Publication Data

US 2019/0069647 A1 Mar. 7, 2019

(51) Int. Cl.

| | |
|---|---|
| ***A44B 11/25*** | (2006.01) |
| ***A44C 5/20*** | (2006.01) |
| ***A44C 5/18*** | (2006.01) |
| ***A44C 25/00*** | (2006.01) |
| *A44C 5/00* | (2006.01) |

(52) U.S. Cl.

CPC ..... *A44C 5/20* (2013.01); *A44C 5/185* (2013.01); *A44C 25/001* (2013.01); *A44C 5/0053* (2013.01)

(58) Field of Classification Search

CPC ..... A44C 25/001; A44C 5/185; A44C 5/20; A44C 5/0053; A44B 11/2511; A44B 11/2507

See application file for complete search history.

(56) References Cited

U.S. PATENT DOCUMENTS 2,032,696 A * 3/1936 Goldblatt ..... G04B 37/0033 224/170
3,427,823 A * 2/1969 Musillo ..... A44C 5/20 59/85
3,514,816 A * 6/1970 Inoue ..... A44B 11/2511 24/196
3,522,640 A * 8/1970 Lohr ..... A44B 11/2511 24/656
3,555,631 A * 1/1971 Inoue ..... A44B 11/2511 24/637
3,675,281 A * 7/1972 Stephenson ..... A44B 11/2511 24/656
3,795,030 A * 3/1974 Yates ..... A44B 11/2511 24/637
3,846,876 A * 11/1974 Weman ..... A44B 11/2511 24/641
3,868,627 A * 2/1975 Lawwill ..... A44B 11/2511 340/457.1
3,897,611 A * 8/1975 Booth ..... A44B 11/2511 24/628

(Continued)

*Primary Examiner* — Jason W San

(74) *Attorney, Agent, or Firm* — Patterson + Sheridan, LLP

(57) ABSTRACT

A lock mechanism includes a chain component and a lock connector component. The chain component has a head portion at one end. The lock connector component has a button portion, an accommodating space, and an opening disposed on a side adjacent to the button portion, wherein the opening space connects to the accommodating space. When the button portion is operated in a pressed state, the button portion is configured to block the head portion from entering or exiting the accommodating space via the opening. When the button portion is operated in a depressed state, the button portion is configured to allow the head portion to enter or exit the accommodating space via the opening.

7 Claims, 3 Drawing Sheets

(56) References Cited

U.S. PATENT DOCUMENTS

| | | | | | |
|---|---|---|---|---|---|
| 4,392,280 | A * | 7/1983 | Gavagan | A44B 11/2511 | 24/637 |
| 4,542,631 | A * | 9/1985 | Esser, III | A44C 25/00 | 206/457 |
| 4,611,369 | A * | 9/1986 | Wier | A44B 11/2523 | 24/635 |
| 4,642,857 | A * | 2/1987 | Ono | A44B 11/2511 | 24/637 |
| 5,157,945 | A * | 10/1992 | Giehl | A44C 3/00 | 63/23 |
| 6,243,929 | B1 * | 6/2001 | Curwood | A44C 5/2019 | 24/598.2 |
| 7,637,230 | B1 * | 12/2009 | Eicks | A01K 15/003 | 119/712 |
| 2012/0279028 | A1 * | 11/2012 | Walega | A44B 11/2523 | 24/603 |

* cited by examiner

LOCK MECHANISM FOR ACCESSORIES

BACKGROUND

1. Technical Field

The present disclosure generally relates to a lock mechanism for accessories; particularly, the present disclosure relates to a lock mechanism for engaging at least one head component of a chain component.

2. Description of the Related Art

As the market for jewelry accessories increases, competition between companies to provide jewelry accessories that are both innovative and functional in design also correspondingly increases. However, one major with accessories such as necklaces or bracelets is that they are hard to put on and take off without significant struggle as the connector components are tiny and hard to operate. Correspondingly, there is a need for a new lock mechanism to simplify and lessen this difficulty for the customer.

SUMMARY

It is an objective of the present disclosure to provide a lock mechanism for accessories that can engage at least one head component to connect said head component to the lock mechanism.

According to one aspect of the disclosure, a lock mechanism for accessories is provided. The lock mechanism includes a chain component and a lock connector component. The chain component has a head portion at one end. The lock connector component has a button portion, an accommodating space, and an opening disposed on a side adjacent to the button portion, wherein the opening space connects to the accommodating space. When the button portion is operated in a pressed state, the button portion is configured to block the head portion from entering or exiting the accommodating space via the opening. When the button portion is operated in a depressed state, the button portion is configured to allow the head portion to enter or exit the accommodating space via the opening.

DETAILED DESCRIPTION

Embodiments of the present disclosure provide lock mechanism for accessories. In the following detailed description, references are made to the accompanying drawings that form a part hereof, and in which are shown by way of illustration specific embodiments or examples. These embodiments are only illustrative of the scope of the present disclosure, and should not be construed as a restriction on the present disclosure. Referring now the drawings, in which like numerals represent like elements through the several figures, aspects of the present disclosure and the exemplary operating environment will be described.

The present disclosure provides a lock mechanism for accessories. In some embodiments, the accessories can include jewelry accessories such as necklaces, bracelets, pendants, and accessory chains. However, the lock mechanism of the present disclosure is not limited or restricted to these applications.

Figure 1:
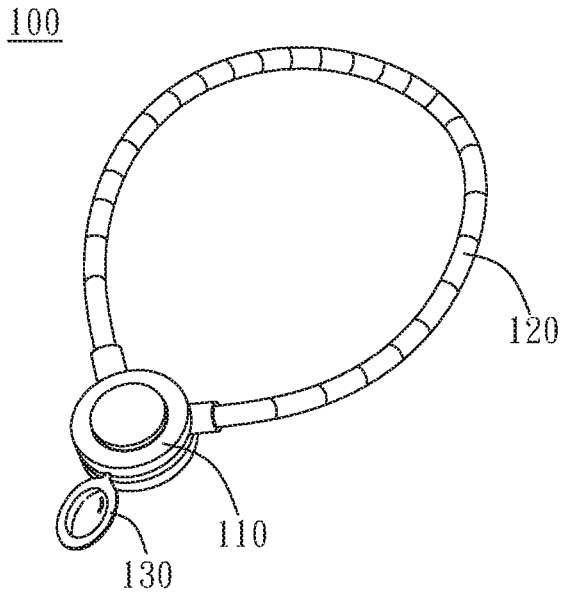
FIG. 1 is a view of an embodiment of an lock mechanism of the present disclosure.

Referring to FIG. 1, an embodiment of the lock mechanism 100 of the present disclosure is shown. In the present embodiment, the lock mechanism 100 is illustrated as a necklace accessory. However, it should be noted that the lock mechanism 100 can also be applied towards other different accessories as a connector. As illustrated in FIG. 1, the lock mechanism 100 can include a lock connector component 110 and a chain component 120. Alternatively, the lock mechanism 100 can further include an accessory component 130.

In the present embodiment, the lock connector component 110 has a circular shape. However, in other different embodiments, the lock connector component 110 may be formed of other different shapes, such as a heart shape, triangular shape, rectangular shape, octagonal shape, or any other shapes.

The chain component 120 preferably has two ends respectively connected and locked into the lock connector component 110. However, in other different embodiments, the chain component 120 may have more than two ends that can be connected and locked into the lock connector component 110, or only one end of the chain component 120 is connected and locked into the lock connector component 110. In addition, multiple different chains may be connected and locked into the lock connector component 110.

As illustrated in FIG. 1, the accessory component 130 may be a pendant that is connected to the lock connector component 110 in similar fashion to how the chain component 120 is connected and locked into the lock connector component 110. In other different embodiments, multiple number of similar or different accessory components 130 may be connected and locked into the lock connector component 110.

Figure 2:
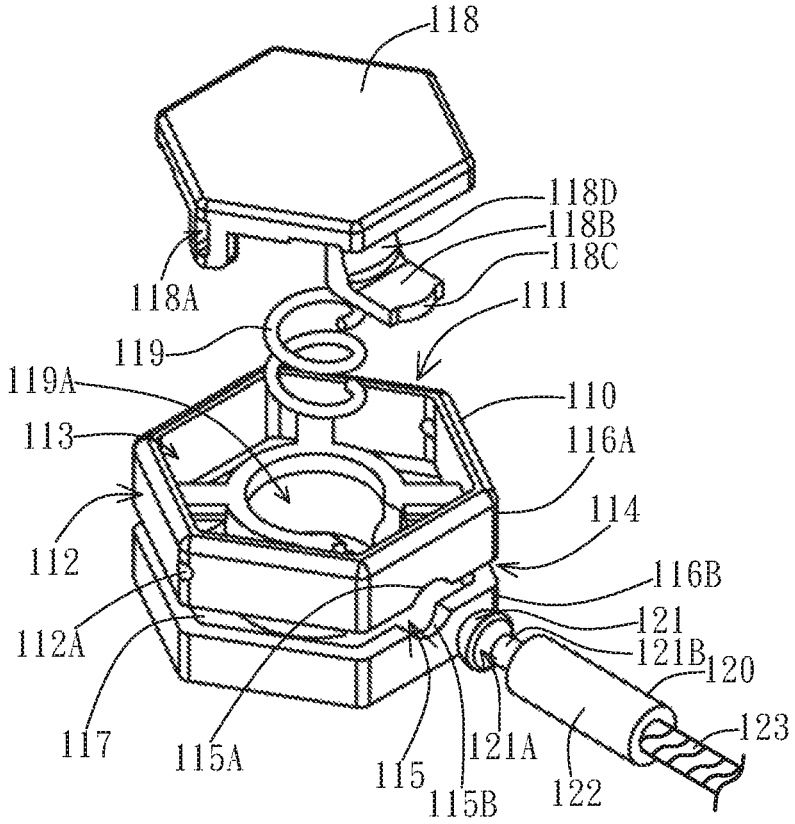
FIG. 2 is an exploded view of an embodiment of the lock mechanism of the present disclosure.

Referring to FIG. 2, FIG. 2 is an exploded view of the lock connector component 110 and the chain component 120 of the lock mechanism 100 of FIG. 1. In the present embodiment, the chain component 120 can include a chain portion 123. At an end of the chain portion 123, the chain portion 123 is connected to a connector housing 122.

In the present embodiment, the chain portion 123 is inserted and fixed into the connector housing 122. However, other different method of fixing the connector housing 122 to the chain portion 123 may be employed instead.

As shown in FIG. 2, a head portion 121 is disposed at an end of the connector housing 122 opposite the end that connects to the chain portion 123. In the present embodiment, the head portion 121 is formed as a dome shape or mushroom shape. However, in other different embodiments, the head portion 121 may be formed as a flat head, cone head, cylinder head, or any other different shapes.

The head portion 121 is connected to the connector housing 122 via a bridge 121B. In the present embodiment, the bridge 121B is formed as a cylinder shape with its axis being aligned with the axes of the connector housing 122 and the chain portion 123. However, in other different embodiments, the bridge 121B may be shaped in other different shapes where the cross-section perpendicular to the axis of the bridge forms a triangle, rectangle, octagon, or any other polygonal shape. In addition, in other different embodiments, the cross sections perpendicular to the axis of the bridge 121B may be different shapes at different portions of the bridge 121B. For instance, at one portion of the bridge 121B, the shape of the cross section perpendicular to the axis of the bridge 121B may be a cylinder. However, the shape of the cross section at another portion of the bridge 121B may morph into another shape from the cylinder shape, such as an octagonal shape.

As shown in FIG. 2, the bridge 121B connects the connector housing 122 to the head portion 121, wherein the bridge 121B connects to a surface 121A of the head portion 121. In the present embodiment, the surface 121A of the head portion is a flat or relatively flat surface that is substantially perpendicular to the axis of the bridge 121. However, in other different embodiments, the surface 121A may be a curved surface, such as a concave or convex surface. Furthermore, the surface 121A may also not be substantially perpendicular to the axis of the bridge 121B. For instance, the surface 121A may be slanted at an angle to plane perpendicular to the axis of the bridge 121B.

As illustrated in FIG. 2, the lock connector component 110 is shaped as a hexagonal shape. However, the lock connector component 110 can be shaped as other different shapes such as a circular shape, cylinder shape, or another other different polygonal shape. In the present embodiment, the lock connector component 110 includes a button portion 118, a spring component 119, a top base portion 116A, and a bottom base portion 116B. The top base portion 116A is connected to the bottom base portion 116B, wherein one or more sides of the top base portion 116A is gapped with one or more sides of the bottom base portion 116B by a slot gap 114.

On at least one pair of corresponding sides of the top base portion 116A and the bottom base portion 116B, an opening 115 is formed on the one pair of corresponding sides of the top base portion 116A and the bottom base portion 116B. In the present embodiment, the opening 115 forms a circular shape by the concave recesses 115A and 115B formed respectively on the corresponding sides of the top base portion 116A and the bottom base portion 116B. The opening 115 allows the head portion 121 of the chain component 120 to enter the lock connector component 110 and rest within the accommodating space 117 of the lock connector component 110. Accordingly, it can be seen that the shape of the opening 115 preferably corresponds to the shape of the largest dimension cross section (perpendicular to the axis of the bridge 121) of the head portion 121. In this instance, since the head portion 121 is formed as a dome or mushroom shape, the largest dimension cross section of the head portion 121 will be a circular shape, the shape of the opening 115 will correspondingly be a circular shape. However, it can be easily seen that if the head portion 121 has a different shape wherein the largest dimension cross section is not a circular shape, the shape of the opening 115 may be adjusted to still allow the head portion 121 to gain access to the accommodating space 117.

In the present embodiment, the button portion 118 is disposed in the hole 113, wherein the spring component 119 is disposed in a foundation space 119A (of the top base portion 116A and the bottom base portion 116B) beneath the button portion 118. The spring component 119 is elastic and has a tendency to try to push the button portion 118 out of the hole 113. Accordingly, in the present embodiment, the top base portion 116A has at least one fixing hole 112A that corresponds to at least one slot hole 118A of the button portion 118. The slot hole 118A is formed on an protrusion that extends on at least one side of the button portion 118. When the button portion 118 is disposed in the hole 113, a fixing pin or screw is inserted into the slot hole 118A and the fixing hole 112A. The fixing pin prevents the button portion 118 from disengaging from the hole 113 when the spring component 119 tries to push the button portion 118 out of the hole 113. However, the slot hole 118A allows the button portion 118 some degree of movement within the vertical direction along the axis of the spring component 119 such that the button portion 118 may be pressed and depressed within the hole 113.

As illustrated in FIG. 2, the opening of the hole 113 is formed from the sides of the top base portion 116A as a hexagonal shape. The button portion 118 is correspondingly formed as a hexagonal shape to fit into the hole 113. However, in other different embodiments, the hole 113 and button portion 118 may be formed in other different shapes from the top base portion 116A. For instance, if the button portion 118 is a circular shape, and the top base portion 116A is a hexagonal shape, the opening of the hole 113 can be formed as a circular shape to receive and accommodate the circular shaped button portion 118.

Figure 3:
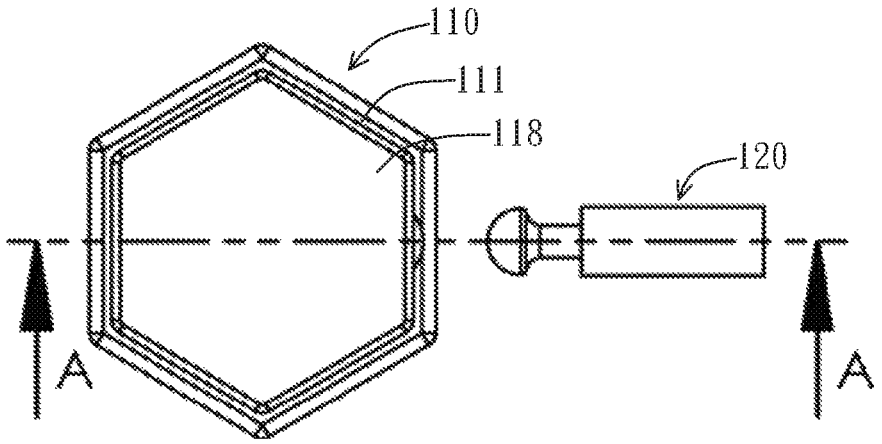
FIG. 3 is a top view of the embodiment of the lock mechanism of FIG. 2.
Figure 4:
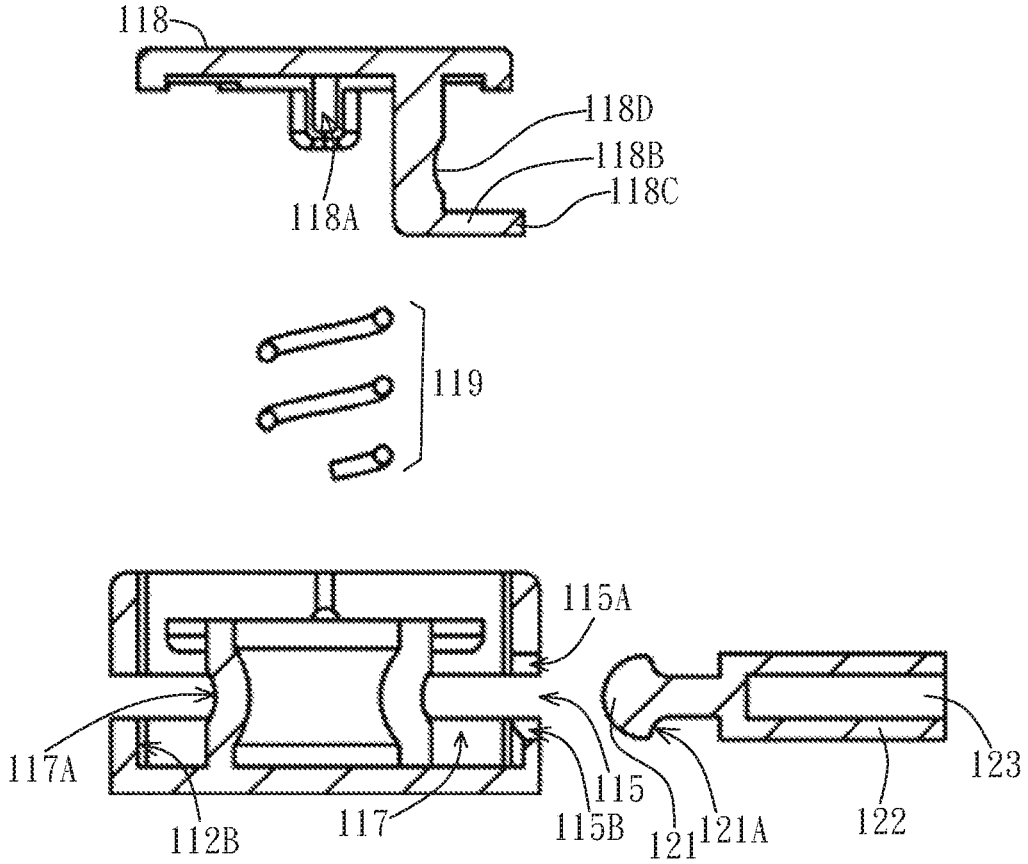
FIG. 4 is a cross-sectional view of the embodiment of the lock mechanism of FIGS. 2 and 3.
Figure 5:
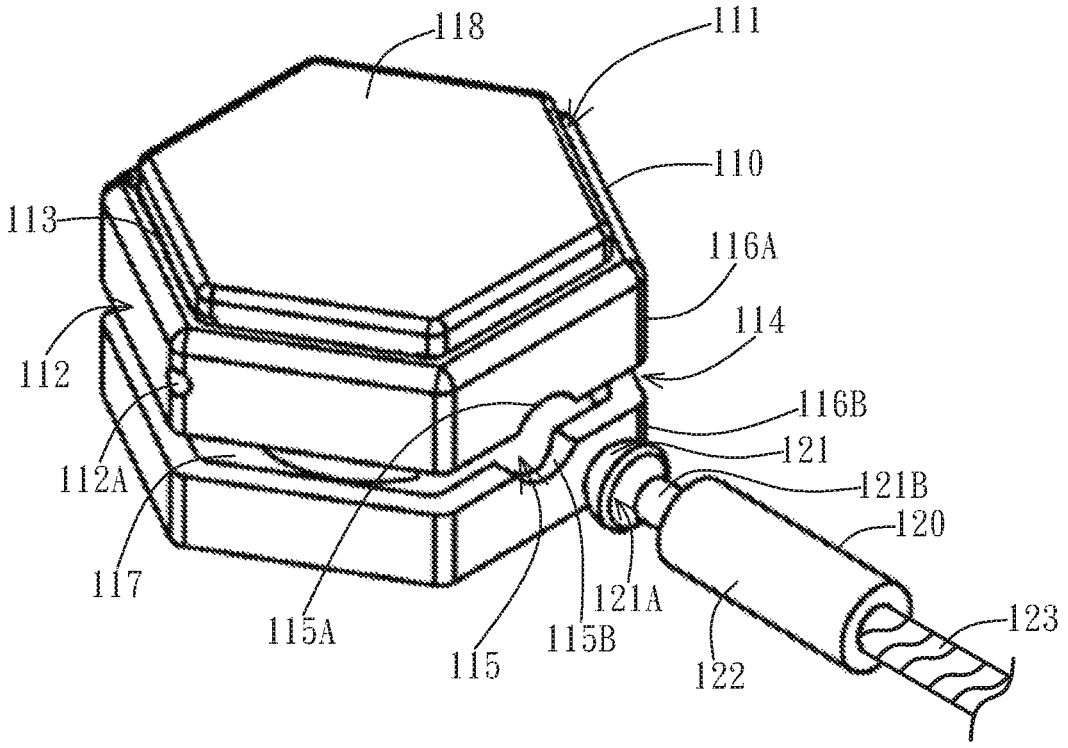
FIG. 5 is an embodiment of the lock mechanism of FIG. 2.

FIG. 3 is a top view of the locking mechanism 100 of the FIG. 2, and FIG. 4 is a cross section of the locking mechanism 100 of the exploded view of FIG. 2 along the direction of A-A indicated in the top view of FIG. 3. FIG. 4 an embodiment of FIG. 2 where all the components of the lock connector component 110 is assembled together.

Referring to FIGS. 2 to 4, in the present embodiment, the button portion 118 includes a L-shaped blocking portion 118B that extends out from the bottom of the button portion 118 and corresponds to the opening 115 when the button portion 118 is disposed in the hole 113 of the top base portion 116A. The blocking portion 118B is used for blocking the head portion 121 of the chain portion 120 from entering into the accommodating space 117 or for blocking the head portion 121 from exiting the accommodating space 117 when the button portion 118 is in the depressed state in the hole 113. In other words, when the button portion 118 is not pressed into the hole 113, the blocking portion 118B will be blocking the entrance to the accommodating space 117 at the opening 115. In this manner, any head portion 121 that are already in the accommodating space 117 will not be able to exit the accommodating space 117 via the opening 115, nor would any other head portion 121 of the same or different chain portion 120 be able to enter into the accommodating space 117 via the opening 115.

In addition, the blocking portion 118B may include a protruding block 118C that extends out at an end of the blocking portion 118B opposite to the end of the blocking portion 118B connecting to the bottom of the button portion 118. In the present embodiment, the protruding block 118C is formed as a concave block that extends into the opening 115. In other words, the protruding block 118C extends into the gap between the recesses 115A and 115B. When the button portion 118 is pressed or depressed, the protruding block 118C can slide in the vertical direction between the recesses 115A and 115B within the opening 115. It should be noted that since the head portion 121 is used for entering or exiting the opening 115, when the blocking portion 118B has the protruding block 118C, the recess 115B formed on the bottom base portion 116B may be formed bigger than the recess 115A of the top base portion 116A in order to accommodate the protruding block 118C in the opening 115 while still allowing the head portion 121 to enter or exit through the opening 115. In other words, the recesses 115A and 115B may be formed corresponding to each other but may be respectively non-symmetrical to each other in shape and/or dimensions.

However, in other different embodiments, the protruding block 118C may be other shapes that extend into the space of the opening 115 formed between the recesses 115A and 115B. In addition, in other different embodiments, the protruding block 118C may not extend into the opening 115. In other words, the protruding block 118C may reside within the accommodating space 117 at the entrance to the accommodating space 117 of the opening 115, and block the head portion 121 from entering or exiting the lock connector component 110 when the button portion 118 is in the depressed state.

Furthermore, the blocking portion 118B may also include a curved reception surface 118D on an inner surface facing the opening 115. In the present embodiment, when the button portion 118 is in the pressed state, the plane of the blocking portion 118B that is parallel with the top surface 118 (perpendicular to the surface that the curved reception surface 118D is located) will be lowered into or substantially close into the accommodating space 117 of the bottom base portion 116B (please refer to FIGS. 2 and 4). The head portion 121 of the chain component 120 can then enter the lock connector component 110 via the opening 115.

In the present embodiment, the curved reception surface 118D is preferably shaped to at least partially conform to the shape of the of the head portion 121 such that when the head portion 121 is inserted into the lock connector component 110 via the opening 115, the curved reception surface 118D can stably receive and restrict the head portion 121 from being inserted further. The curved reception surface 118D positions the head portion 121 to be in the optimal position to be allowed to slide smoothly left or right into the accommodating space 117, wherein the bride 121B is then situated in the slot gap 114.

When the head portion 121 is accommodated in the accommodating space 117, the surface 121A of the head portion 121 will be aligned against the inner surface 112B of the top base portion 116A and bottom base portion 116B and prevent the head portion 121 from escaping or exiting the accommodating space 117.

In addition, when the button portion 118 is in the depressed state (ie. not pressed into the hole 113), the blocking portion 118B is at least partially blocking the entrance/exit of the opening 115 in the accommodating space 117. In other words, the head portion 121 would not be able to get into the optimal position to exit out of the accommodating space 117 via the opening 115. The only way for the head portion 121 to exit the accommodating space 117 is for the button portion 118 to be pressed further into the hole 113 such that the blocking portion 118B is lowered into the accommodating space 117 of the bottom base portion 116B and the opening 115 is once again accessible to the head portion 121. The head portion 121 can then be slide back to in front of the curved reception surface 118D, and then the connector housing 122 can be pulled on to drive the head portion 121 to exit the lock connector component 110 via the opening 115.

Although the embodiments of the present disclosure have been described herein, the above description is merely illustrative. Further modification of the disclosure herein disclosed will occur to those skilled in the respective arts and all such modifications are deemed to be within the scope of the disclosure as defined by the appended claims.

What is claimed is:

1. A lock mechanism for accessories, the lock mechanism comprising:

a chain component having a head portion at one end;

a lock connector component having a button portion, an accommodating space, and an opening disposed on a side adjacent to the button portion, wherein the opening space connects to the accommodating space; and a spring component, wherein the spring component is disposed in the lock connector component beneath the button portion;

wherein when the button portion is operated in a pressed state, the button portion is configured to block the head portion from entering or exiting the accommodating space via the opening; and when the button portion is operated in a depressed state, the button portion is configured to allow the head portion to enter or exit the accommodating space via the opening;

wherein the button portion further includes a blocking portion disposed between the opening and the spring component, the blocking portion formed extending downward from a bottom surface of the button portion; when the button portion is operated in the depressed state, the blocking portion blocks the opening; when the button portion is operated in the pressed state, the blocking portion does not block the opening; and wherein the blocking portion is formed as a L-shape plate, and a plane of the L-shape parallel to a top surface of the button portion at least partially blocks the opening when the button portion is operated in the depressed state.

2. The lock mechanism of claim 1, wherein lock connector component further includes a slot gap connected to the opening, and the chain component has a bridge that connects to the head portion, wherein when the head portion is accommodated in the accommodating space, the bridge is accommodated in the slot gap.

3. The lock mechanism of claim 2, wherein the chain component has a connector housing and a chain portion, the chain portion is connected inserted fixed into the connector housing, and the connector housing is connected to the head portion via the bridge, wherein the head portion, the bridge, and the connector housing is unibody formed.

4. The lock mechanism of claim 1, wherein the blocking portion further includes a curved reception surface on an inner surface facing the opening, wherein the curved reception surface receives the head portion when the head portion is inserted into the lock connector component via the opening.

5. The lock mechanism of claim 1, wherein a protruding block is formed on an end of the plane parallel to the top surface of the button portion, and the protruding block extends into the opening.

6. The lock mechanism of claim 1, wherein the lock connector component includes a top base portion and a bottom base portion, the slot gap is formed between the top base portion and the bottom base portion, and the blocking portion at least partially resides in the accommodating space of the bottom base portion when the button portion is operated in the pressed state.

7. The lock mechanism of claim 1, wherein the lock connector component includes a top base portion and a bottom base portion, and an hole is formed on the top of the top base portion, the button portion is disposed in the hole.

* * * * *